US010329821B2

(12) United States Patent
Buschmann

(10) Patent No.: US 10,329,821 B2
(45) Date of Patent: Jun. 25, 2019

(54) HINGE FOR FURNITURE OR DOMESTIC APPLIANCES

(71) Applicant: HETTICH-ONI GMBH & CO. KG, Vlotho (DE)

(72) Inventor: Alexander Buschmann, Herford (DE)

(73) Assignee: HETTICH-ONI GMBH & CO. KG, Vlotho (DE)

( * ) Notice: Subject to any disclaimer, the term of this patent is extended or adjusted under 35 U.S.C. 154(b) by 217 days.

(21) Appl. No.: 15/311,574

(22) PCT Filed: May 13, 2015

(86) PCT No.: PCT/EP2015/060684
§ 371 (c)(1),
(2) Date: Nov. 16, 2016

(87) PCT Pub. No.: WO2015/173349
PCT Pub. Date: Nov. 19, 2015

(65) Prior Publication Data

US 2017/0101814 A1 Apr. 13, 2017

(30) Foreign Application Priority Data

May 16, 2014 (DE) ..... 10 2014 106 908

(51) Int. Cl.
*E05F 5/00* (2017.01)
*E05D 3/12* (2006.01)
*E05F 5/02* (2006.01)

(52) U.S. Cl.
CPC ..... *E05F 5/006* (2013.01); *E05D 3/12* (2013.01); *E05F 5/02* (2013.01); *E05Y 2201/22* (2013.01);
(Continued)

(58) Field of Classification Search
CPC .... E05F 5/006; E05F 5/02; E05D 3/12; E05Y 2201/24; E05Y 2201/26; E05Y 2201/624; E05Y 2600/46; E05Y 2600/20
See application file for complete search history.

(56) References Cited

U.S. PATENT DOCUMENTS 8,307,498 B2 11/2012 Krammer
8,490,248 B2 * 7/2013 Chen ..... H05K 5/0226 16/264
(Continued)

FOREIGN PATENT DOCUMENTS

CN 102428242 4/2012
DE 202013009699 U 11/2013
(Continued)

OTHER PUBLICATIONS

Office Action issued in related Japanese patent application (dated Jul. 3, 2017).
(Continued)

*Primary Examiner* — Victor D Batson
*Assistant Examiner* — Matthew J Sullivan
(74) *Attorney, Agent, or Firm* — Barnes & Thornburg LLP

(57) ABSTRACT

A hinge comprises a hinge part, which can be secured on a door of the shutter and is mounted on a side part such that it can be pivoted via a carrying lever and a guide lever, also comprises at least one spring, by means of which the hinge part, in a self-retracting region of the hinge, is prestressed into a closed position, and further comprises a linear damper with a piston rod, which can be moved relative to a damper housing and is intended for damping a closing and/or opening movement of the hinge part, wherein a deflecting element is provided, said deflecting element being mounted on the side part such that it can be rotated about an axis and being arranged between the damper and the guide lever so
(Continued)

that, during a closing movement of the hinge part, it moves the damper in order to generate a damping force, wherein, during an opening movement of the hinge part, the deflecting element moves the damper in order to generate a damping force before the fully open position of the hinge part has been reached. This makes it possible to avoid hard impact of a door in the opening direction.

20 Claims, 3 Drawing Sheets

(52) U.S. Cl.
CPC ..... *E05Y 2201/24* (2013.01); *E05Y 2201/266* (2013.01); *E05Y 2201/624* (2013.01); *E05Y 2600/46* (2013.01); *E05Y 2800/22* (2013.01); *E05Y 2800/29* (2013.01); *E05Y 2800/73* (2013.01); *E05Y 2900/20* (2013.01)

(56) References Cited

U.S. PATENT DOCUMENTS

2009/0119876 A1* 5/2009 Pecar ..... E05D 3/142 16/293
2010/0139041 A1* 6/2010 Pecar ..... E05F 5/006 16/273
2016/0123062 A1* 5/2016 Worner ..... E05F 3/102 16/62

FOREIGN PATENT DOCUMENTS

| | | |
|---|---|---|
| EP | 2589736 | 5/2013 |
| WO | 2008083417 | 7/2008 |
| WO | 2009124332 | 10/2009 |
| WO | WO 2009/012433 | 10/2009 |
| WO | 2010108203 | 9/2010 |
| WO | 2013029068 | 3/2013 |
| WO | WO 2013/120117 | 8/2013 |

OTHER PUBLICATIONS

International Search Report of PCT/EP2015/060684 dated Jul. 15, 2015.
English translation of International Search Report of PCT/EP2015/060684 dated Jul. 15, 2015.
Search Report issued in German Application No. 102014106908.0 dated Jun. 30, 2014.

* cited by examiner

Fig. 2A
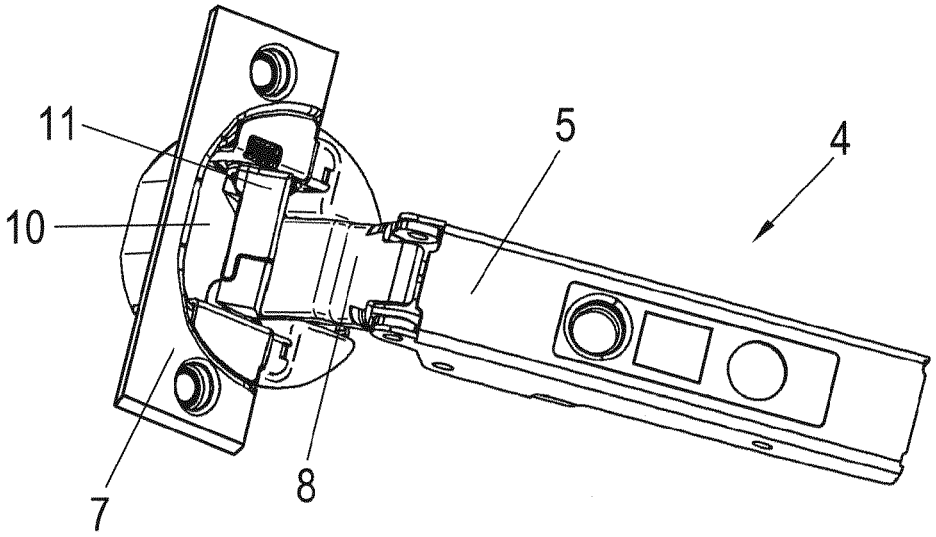
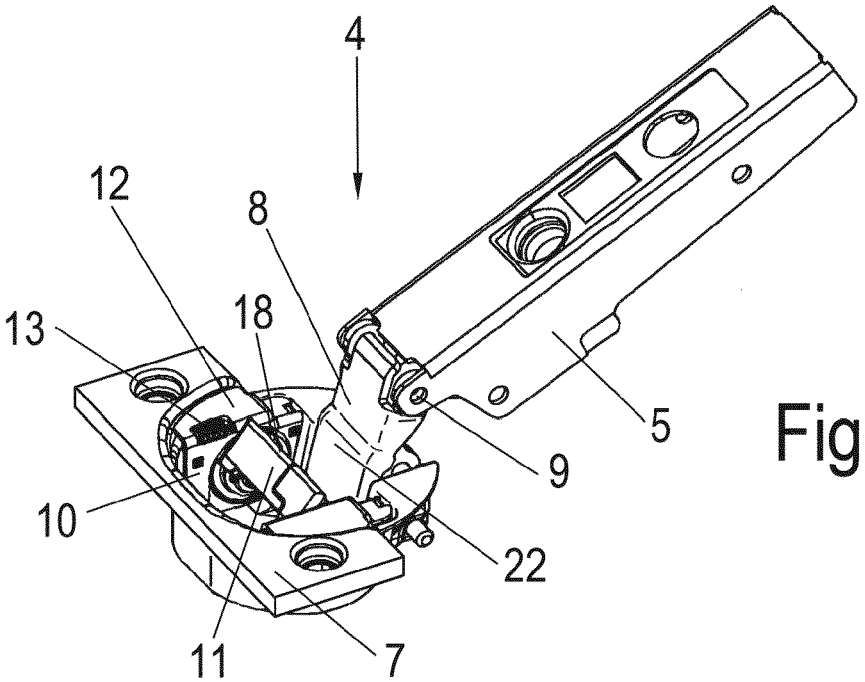
Fig. 2B

HINGE FOR FURNITURE OR DOMESTIC APPLIANCES

CROSS REFERENCE TO RELATED APPLICATIONS

This application is a U.S. nationalization under 35 U.S.C. § 371 of International Application No. PCT/EP2015/060684, filed May 13, 2015, which claims priority to German Application No. 102014106908.0 filed May 16, 2014.

BACKGROUND AND SUMMARY OF THE DISCLOSURE

The present disclosure relates to a hinge for furniture or domestic appliances, having a side part, on which a hinge part is mounted so it is pivotable via at least one guide lever, wherein a damping device is provided, which has a rotatable actuating element, which is pre-tensioned via a spring in a starting position, wherein a first activation region of the actuating element for closing damping is activated upon closing of the hinge.

WO 2009/124332 discloses a damping device for a hinge, in which a rotatable actuating element, which acts on a rotation damper, is provided on a hinge cup. The actuating element is moved into a starting position for the next damping stroke after completed damping, wherein a restoring stroke of the actuating element is settable to be able to vary the damping forces. The damping forces can thus be set for a closing damping. However, the problem exists that in the event of a rapid opening movement of a door, the hinges are subjected to high loads, which can result in damage.

The present disclosure illustrates and describes a hinge for furniture or domestic appliances, in which a door is decelerated both during a closing movement and also during an opening movement.

The hinge according to the disclosure comprises a damping device, which has a rotatable actuating element, wherein a first activation region of the actuating element for closing damping is activated upon closing of the hinge and the actuating element has a second activation region for opening damping. The damping device can thus be used both for opening damping and also for closing damping. In particular during a rapid movement of the door, a deceleration can therefore be performed in the closing direction and in the opening direction, which avoids loud striking noises and additionally reduces the risk of damage due to rapid movements of a door.

The actuating element may be moved in the same direction during the closing damping and during the opening damping. The same damping mechanism can thus be used for the opening damping and the closing damping, wherein the actuating element is pre-tensioned by a spring in a starting position between the two movements. This avoids the provision of two separate damping devices, which would make the production significantly more expensive.

According to one embodiment, the actuating element is mounted so it is rotatable about an axis on the hinge part and has a first arm having the first activation region and a second arm having the second activation region. The first arm and the second arm can be aligned offset in relation to one another by at least 30°, for example, at least 90° in this case with respect to the axis of rotation of the actuating element. The actuating element is therefore designed as a two-armed lever, which has the activation regions in each case on different arms. The actuating element can also be designed as a molded part, however, on which the activation regions are provided.

A guide lever may be a first contact region, which is engaged with the first activation region of the actuating element during the closing damping, wherein the guide lever additionally has a second contact region, which is engaged with the second activation region of the actuating element during the opening damping. In this case, the contact regions can be spaced apart from one another on the guide lever, in particular, the second contact region can be arranged on a cantilever of the guide lever adjacent to an axis of the guide lever in the hinge part.

In an embodiment, the damping device may be active at least over an angle range of at least 10°, for example, at least 20°, before the maximally open position. The maximally open position can be in a range between 80° and 120° in this case, for example, so that depending on the position of the maximally open position, the opening damping of the hinge can begin. A damping over a range of at least 20° may ensure sufficient deceleration before the maximally open position.

For a compact construction, the damping device can comprise a rotation damper. Of course, it is also possible that the actuating element is coupled to another type of damper, for example, a linear damper or a friction damper.

In one embodiment, a cup-shaped receptacle is formed in the hinge part, in which the rotatable actuating element is arranged. A particularly compact construction for the function of the opening damping and closing damping thus results.

BRIEF DESCRIPTION OF THE DRAWINGS

FIGS. 2A and 2B show two views of a hinge from FIG. 1.

DETAILED DESCRIPTION OF THE DRAWINGS

Figure 1:
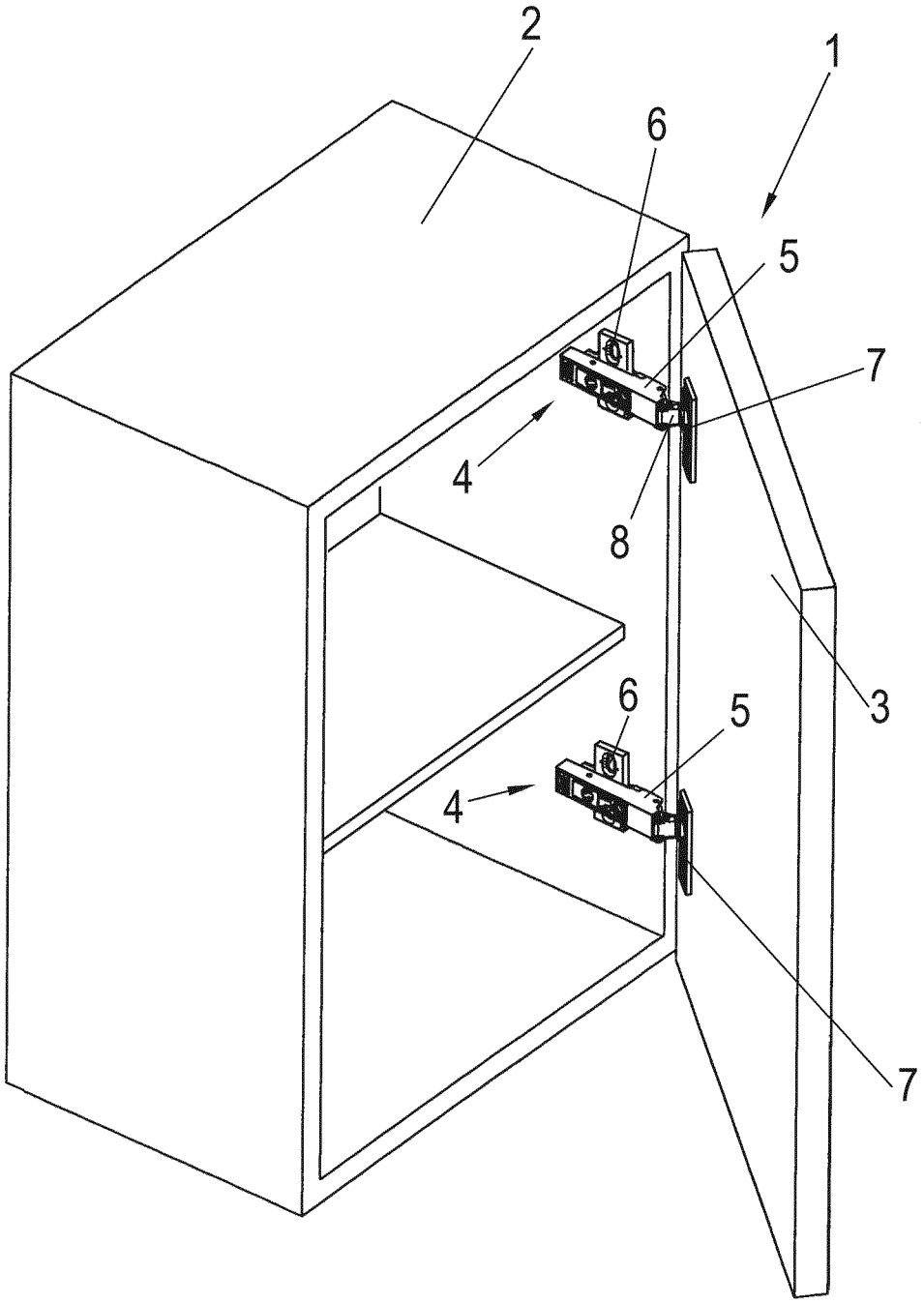
FIG. 1 shows an item of furniture having two hinges according to the present disclosure.

An item of furniture 1 comprises a cabinet-shaped furniture body 2, on which a door 3 is mounted so it is pivotable. Two hinges 4 are provided for this purpose on a side wall of the furniture body 2.

Each hinge 4 comprises a side part 5, which is fixed via a mounting plate 6 on the furniture body 2. A hinge part 7 is mounted so it is pivotable on the side part 5 via two spaced-apart guide levers 8. The pivotable door 3 is held on the hinge part 7.

One of the hinges 4 is shown in detail in FIGS. 2A and 2B. One of the guide levers 8 is mounted so it is rotatable about an axis 9 on the side part 5. On the opposite side, the guide lever 8 is arranged so it is rotatable on the hinge part 7, wherein a cup-shaped receptacle 10, in which a rotatable actuating element 11 is arranged, is formed in the hinge part 7. The actuating element 11 is arranged on a holder 12, which has a rotation damper. The actuating element 11 is mounted so it is rotatable in this case and is pre-tensioned in a starting position. If the hinge 4 is moved into a closed position, a first activation region 18 on the actuating element 11 engages with a contact region 22 on the guide lever 8 and can slide along this contact region 22, so that the actuating element 11 is rotated and therefore the closing movement is damped and/or decelerated. After completed damping and opening of the door 3, the actuating element 11 is pre-tensioned in a starting position again via a spring, to be movable for the next damping stroke.

Furthermore, a switch 13 is provided on the holder 12, by means of which the restoring stroke of the actuating element 11 is settable in a known manner.

Figure 3:
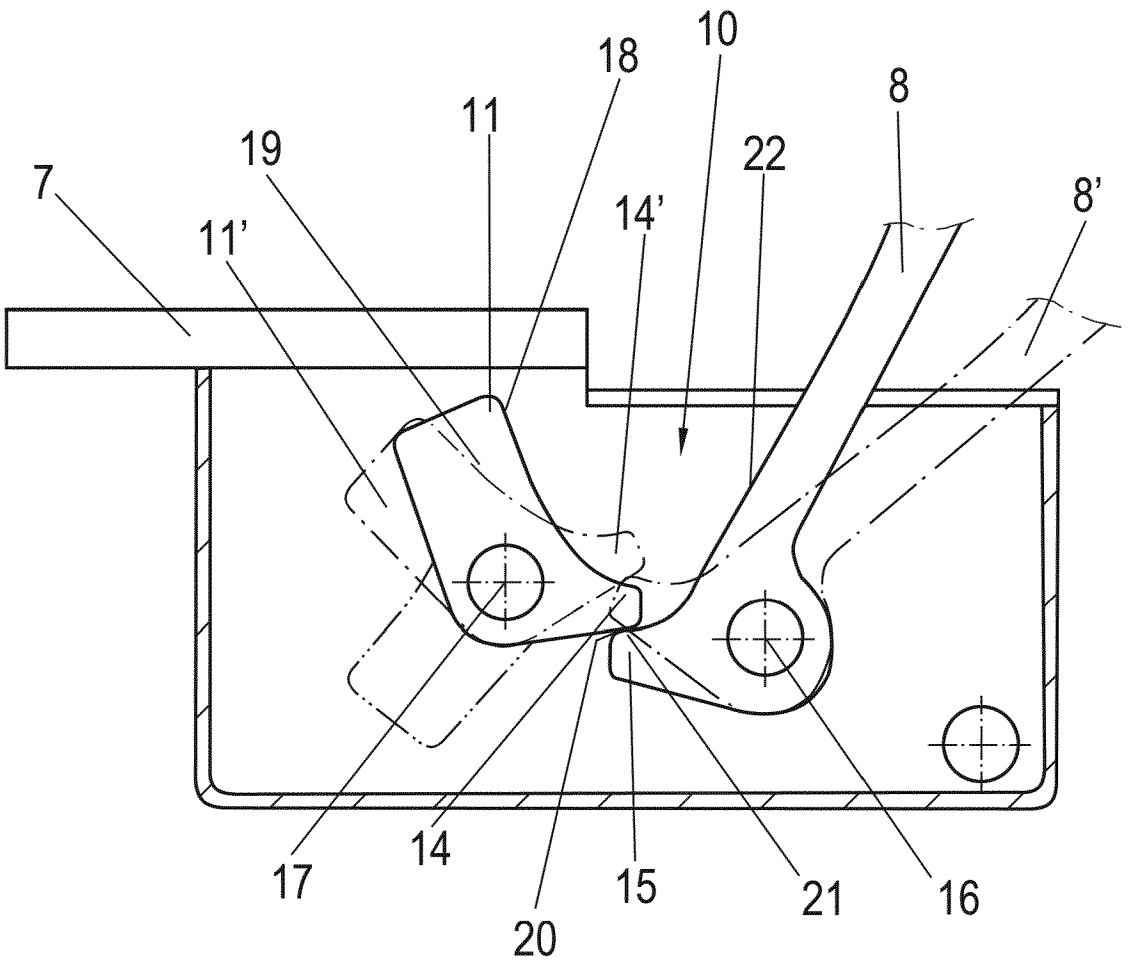
FIG. 3 shows a detailed view of the hinge from FIG. 2.

In addition to the closing damping, an opening damping can also be performed on the hinge 4, wherein a second activation region 20 is provided for this purpose on the actuating element 11, as shown in FIG. 3. The actuating element 11 is essentially designed as a two-armed lever and has a first arm 19, on which the first activation region 18 is provided. Furthermore, a second arm 14 is provided, which is aligned offset by more than 90° in relation to the first arm 19 with respect to an axis of rotation 17 of actuating element 11 and on which the second activation region 20 is provided.

The guide lever 8 is mounted so it is rotatable about an axis 16 on the hinge part 7 and has the first contact region 22 on the region between the axis 16 and the axis 9, to move the actuating element 11 during a closing movement. Furthermore, a cantilever 15 is formed on the guide lever 8 adjacent to the axis 16 on the hinge part 7, which cantilever protrudes at an angle from the guide lever 8 and on which a second contact region 21 is provided, which engages with the second activation region 20 on the actuating element 11 during an opening movement. If the hinge is now moved further in the opening direction, the guide lever 8 is pivoted into the dashed position 8', wherein the actuating element 11 is pivoted counterclockwise in FIG. 3, as shown by the dashed lines. The first arm 19' and the second arm 14' are therefore also pivoted about the axis 17 when the hinge 4 is arranged in a predetermined open position. Both a closing damping and also an opening damping are thus caused using the same damping device.

The opening damping may take place at least in an angle range of at least 10° before the maximally open position. In an embodiment, the opening damping can begin in a range between 20° and 30° before the maximally open position. If the door 3 is moved back in the closing direction after opening damping, firstly the cantilever 15 disengages from the second arm 14 of the actuating element 11, so that the actuating element 11 is moved by the force of a spring back into the starting position. The first contact region 22 of the guide lever 8 only subsequently then engages with the first activation region 18 on the first arm 19.

In the illustrated embodiment, a rotation damper is used for damping the movement of the actuating element 11. Of course, it is also possible to use a friction damper or a linear damper instead of a rotation damper.

In addition, the damping device can have an adjustment mechanism, to be able to set the damping stroke of the actuating element 11.

The invention claimed is:

1. A hinge having a side part, on which a hinge part is mounted so it is pivotable via at least one guide lever and a damping device, the damping device having a rotatable actuating element, which is pre-tensioned via a spring in a starting position, wherein a first activation region of the actuating element for closing damping is activated upon closing of the hinge, wherein the actuating element has a second activation region for opening damping, wherein the actuating element-is mounted so it is rotatable on the hinge part about an axis and has a first arm-having the first activation region and a second arm having the second activation region, and wherein the first arm-and the second arm are aligned offset in relation to one another by at least 30° in relation to the axis of rotation.

2. The hinge according to claim 1, wherein the actuating element is moved in the same direction during the closing damping and the opening damping.

3. The hinge according to claim 1, wherein a guide lever has a first contact region, which is engaged with the first activation region of the actuating element during the closing damping, and the guide lever has a second contact region, which is engaged with the second activation region of the actuating element during the opening damping.

4. The hinge according to claim 3, wherein the second contact region is arranged on a cantilever of the guide lever adjacent to an axis of the guide lever in the hinge part.

5. The hinge according to claim 1, characterized in that the opening damping extends at least over an angle range of 10°, in particular at least 20°, before the maximally open position.

6. The hinge according to claim 1, wherein the damping device comprises a rotation damper.

7. The hinge according to claim 1, wherein a cup-shaped receptacle is formed in the hinge part, in which the rotatable actuating element is arranged.

8. A hinge, having a side part, on which a hinge part is mounted so it is pivotable via at least one guide lever and a damping device, the damping device having a rotatable actuating element, which is pre-tensioned via a spring in a starting position, wherein a first activation region of the actuating element for closing damping is activated upon closing of the hinge, wherein the actuating element has a second activation region for opening damping;

wherein the actuating element is moved in the same direction during the closing damping and the opening damping;

wherein the actuating element is mounted so it is rotatable on the hinge part about an axis and has a first arm having the first activation region and a second arm having the second activation region, and wherein the first arm and the second arm are aligned offset in relation to one another by at least 30° in relation to the axis of rotation.

9. The hinge according to claim 3, wherein the actuating element is moved in the same direction during the closing damping and the opening damping.

10. The hinge according to claim 9, wherein the actuating element is mounted so it is rotatable on the hinge part about an axis and has a first arm having the first activation region and a second arm having the second activation region.

11. The hinge according to claim 4, wherein the actuating element is moved in the same direction during the closing damping and the opening damping.

12. The hinge according to claim 11, wherein the actuating element is mounted so it is rotatable on the hinge part about an axis and has a first arm having the first activation region and a second arm having the second activation region.

13. A hinge having a side part, on which a hinge part is mounted so it is pivotable via at least one guide lever and a damping device, the damping device having a rotatable actuating element, which is pre-tensioned via a spring in a starting position, wherein a first activation region of the actuating element for closing damping is activated upon closing of the hinge, wherein the actuating element has a second activation region for opening damping, and wherein a guide lever has a first contact region, which is engaged with the first activation region of the actuating element during the closing damping, and the guide lever has a second contact region, which is engaged with the second activation region of the actuating element during the opening damping.

14. The hinge according to claim 13, wherein the second contact region is arranged on a cantilever of the guide lever adjacent to an axis of the guide lever in the hinge part.

15. The hinge according to claim 13, wherein the actuating element is moved in the same direction during the closing damping and the opening damping.

16. The hinge according to claim 15, wherein the actuating element is mounted so it is rotatable on the hinge part about an axis and has a first arm having the first activation region and a second arm having the second activation region.

17. The hinge according to claim 16, wherein the first arm and the second arm are aligned offset in relation to one another by at least 30° in relation to the axis of rotation.

18. The hinge according to claim 14, wherein the actuating element is moved in the same direction during the closing damping and the opening damping.

19. The hinge according to claim 18, wherein the actuating element is mounted so it is rotatable on the hinge part about an axis and has a first arm having the first activation region and a second arm having the second activation region.

20. The hinge according to claim 19, wherein the first arm and the second arm are aligned offset in relation to one another by at least 30° in relation to the axis of rotation.

* * * * *